US006599098B2

(12) United States Patent
Weng et al.

(10) Patent No.: US 6,599,098 B2
(45) Date of Patent: Jul. 29, 2003

(54) THERMOLYSIS REACTION ACTUATING PUMP

(75) Inventors: Kuo-Yao Weng, Hsinchu (TW); Ching-Yi Wu, Hsinchu (TW)

(73) Assignee: Industrial Technology Research Institute, Hsin Chu (TW)

( * ) Notice: Subject to any disclaimer, the term of this patent is extended or adjusted under 35 U.S.C. 154(b) by 0 days.

(21) Appl. No.: 10/039,371

(22) Filed: Dec. 31, 2001

(65) Prior Publication Data

US 2003/0123994 A1 Jul. 3, 2003

(51) Int. Cl.[7] ..... F04B 19/24; F04B 1/18

(52) U.S. Cl. ..... 417/207; 417/53; 417/118; 417/65; 222/146.1

(58) Field of Search ..... 33/527, 427, 454, 33/464; 123/446, 496; 438/38, 655; 222/146.1, 146.5, 395, 394; 251/11; 417/207, 208, 52, 53, 65, 118

(56) References Cited

U.S. PATENT DOCUMENTS 5,129,788 A * 7/1992 Okayasu ..... 417/52

6,071,081 A * 6/2000 Shiraishi ..... 417/52

OTHER PUBLICATIONS

Weng, "Thermolysis Reaction Actuating Pumps, TRAP", Oct. 21–25, 2001, 5th International Conference on Miniaturized Chemical and Biochemical Analysis, Sponsored by the California Separation Science Society, Paper No. P–263–M.*

* cited by examiner

*Primary Examiner*—Charles G. Freay
*Assistant Examiner*—Han L. Liu
(74) *Attorney, Agent, or Firm*—Tung & Associates

(57) ABSTRACT

A thermolysis reaction actuating pump system including a first set of walls defining a channel having a cross-sectional area less than one millimeter squared, and wherein a liquid is received in the channel. A second set of walls defining a reaction chamber and a thermolytic body carried in the reaction chamber. The first set and second set of walls are constructed and arranged to allow the flow of gas from the reaction chamber into the channel. A heater is positioned to provide heat to the thermolytic body and disassociate the thermolytic body to produce gas to pump the liquid through the channel.

45 Claims, 4 Drawing Sheets

THERMOLYSIS REACTION ACTUATING PUMP

FIELD OF THE INVENTION

This invention relates to a microelectromechanical system, and more particularly, to microelectromechanical system having a thermolysis reaction actuating pump.

BACKGROUND OF THE INVENTION

Microelectromechanical systems, often referred to as MEMs, typically are miniature embedded systems including one or many micro-machined components or structures. They often enable higher level functions, although in and of themselves their utility may be limited. For example, a micro-machine pressure sensor is typically useless by itself, but under the hood of a vehicle, such a pressure sensor can be used to control the fuel air mixture of the engine. MEMs often integrate smaller functions into one package for greater utility. For example, MEMs may be used in an acceleration sensor with an electronic circuit for self diagnostics. MEMs can also provide a cost benefit, directly through lower unit pricing, or indirectly by cutting service and maintenance costs.

Micro-mechanical structures, components and systems are miniature devices that enabled operation of complex systems. MEMs currently have a variety of applications including automotive, medical, consumer, industrial and aerospace. MEMs technology includes a variety of design and fabrication processes, many having their foundation in the semiconductor or integrated circuit industry.

Many microelectromechanical systems utilize sensing and actuation techniques. One of the objectives of sensing devices is to transduce a specific physical parameter into electrical energy. An intermediate conversion step may be required. For example, a pressure or acceleration is converted into mechanical stress, which is then converted into electricity. Temperature measurements use the dependency of various material properties on temperature is a common sensing technique. The characteristic is pronounced in the electrical resistance of metals wherein the temperature coefficient of resistance of most metals ranges between 10 and 100 ppm per ° C.

Two other common sensing techniques utilize piezoresistivity and piezoelectricity. Doped silicon exhibits piezoresistive behavior and can be utilized for many pressure and acceleration sensor designs. Measuring the change in resistance and amplifying the corresponding output signal is a technique well known to those skilled in the art. However, silicon piezoresistivity is dependent on temperature that must be compensated for with external electronics.

Capacitive sensing utilizes an external physical parameter that changes either the spacing or the relative dielectric constant between two plates of a capacitor. For example, an applied acceleration moves one of the plates closer to the other. For relative humidity sensors, the dielectric is an organic material whose permittivity is a function of the moisture content. Capacitive sensors provide the advantage of requiring very low-power and are relatively stable with temperature. Further, capacitive sensors can be utilized with electrostatic actuation to provide closed loop feedback.

Another sensing techniques utilizes electromagnetic signals to measure a physical parameter. Magnetoresistive sensors are utilized on the read heads of high-density computer disk drives to measure the change in conductivity of the material slab in response to the magnetic field of the storage bit. Another form of electromagnetic transducing uses Faraday's law to detect motion of a current carrying conductor through a magnetic field.

Once the particular parameter has been sensed and determined to be above a predetermined threshold, it is common for microelectromechanical systems to perform a specific task in response to the sensed parameter. Such a task is typically accomplished by any of a variety of common actuation methods. Typical actuation microelectromechanical systems include electrostatic, piezoelectric, thermal, magnetic, and phase recovery using shaped-memory alloys.

Electrostatic actuation relies on the attractive forces between two plates or elements carrying opposite charges. Two objects with an externally applied potential between them have opposite polarities. Therefore an applied voltage always results in an attractive electrostatic force. Electrostatic actuation can be naturally extended to closed-loop feedback. When sensing circuits detect that two plates of a capacitor are being separated under the effect of an external force (such as acceleration), an electrostatic feedback voltage is immediately applied by the controlled electronics to counteract the disturbance and maintain a fixed capacitance. The magnitude of the feedback voltage then becomes a measure of the disturbing force. This closed loop operation is used in many accelerometers and yaw rate sensors.

Piezoelectric actuation can provide significantly large forces particularly when thick piezoelectric films are utilized. Commercially available piezoceramic cylinders can provide up to a few newtons of force with applied potentials of a few hundred volts. However, thin film piezoelectric actuators can only provide a few millinewtons of force. Both piezoelectric and electrostatic methods offer the advantage of low power consumption because the electric current is very small. Thermal actuation typically requires more power than electrostatic or piezoelectric actuation but can provide actuation forces on the order of hundreds of millinewtons or higher.

There are at least three known approaches to utilizing thermal actuation. The first approach takes advantage of the difference in the coefficient of thermal expansion between two joined layers of the similar materials to cause bending with temperature. One layer expands more than the other as the temperature increases. This results in stress at the interface and consequent bending of the stacked layers. The amount of bending depends on the difference in the coefficient of thermal expansion of the layers in the absolute temperature.

A second approach known as thermopneumatic actuation heats a liquid inside of a sealed cavity. Pressure from expansion or evaporation exerts a force on the cavity walls. The method also depends on the absolute temperature of the actuator.

A third method utilizes the suspension of the beam of the same homogeneous material with one end anchored to a supporting frame of the same material. Heating the beam to the temperature above that of the frame causes a differential expansion of the beam's free end with respect to the frame. Holding the free end stationery gives rise to force proportional to the beam's length and the temperature differential. Such an actuator delivers a maximum force with zero displacement and no force when the displacement is maximal. Designs between these two extremes can provide both force and displacement. Typically a system of mechanical linkages can optimize the output of the actuator by trading off forces for displacement or vice versa. In this system the actuation is independent of fluctuations in ambient temperatures because it relies on the differences in the temperature between the beam and the supporting frame.

Electrical current in a conductive element that is located within a magnetic field produces an electromagnetic force in a direction perpendicular to the current and magnetic field. This force is proportional to the current, magnetic field, and the length of the element. These characteristics are utilized in magnetic actuation devices.

Shape-memory alloys provide the highest energy density available for actuation. The shape-memory alloys are a special class of alloys that return to a predetermined shape when heated above a critical transition temperature. The material remembers its original shape after being strained and deformed. When the alloy is below its transition temperature it has a low yield strength and is readily deformed into new permanent shapes. The deformation can be 20 times larger than the elastic deformation with no permanent strain. When heated above its transition temperature, the alloy completely recovers to its original shape through complex changes in its crystal structure. The process generates large forces making shape memory alloys ideal for actuation purposes. In contrast, piezoelectric and electrostatic actuators produce only a fraction of the force available from a shape-memory alloy, but can act much more quickly.

The above actuation techniques and others can be utilized in a variety of devices for microelectromechanical systems. Such devices may include the micro-mechanical resonators, high frequency filters, grating light valve displays, optical switches, thermo-mechanical data storage devices, RE switches and micropumps. Researchers in the microelectromechanical system fields have recently shown a strong interest in micropumps.

There are variety of micropumps known to those skilled in the art. A variety of such pumps are described in Kovacs, Micromachined Transducers Sourcebook, 1998, in chapter 9 which is briefly summarized hereafter. The micropumps have been used for many applications, including transporting reagents, delivering pulsatile flows, generating pressure differences, moving cooling fluids, transporting suspended particles or cells, and a variety of other applications.

The bubble pump is one of the simplest micropumps designs. The bubble pump uses three repetitive formation and collapse of vapor bubbles that are typically formed by local heating of the fluid to be pumped. The fluid may become quite hot locally, however there are several applications in which this approach is very useful. Bubble pumps have been reported to provide 3.1 nl displacement operating at 0.5 Hz.

Membrane pumps are reciprocating devices. There are variety of different driving forces utilized in membrane pumps. It is known to provide electrostatically driven membrane to generate pressure pulses. A variety of valves are often associative at the operation of such pumps.

Thermally driven membrane pumps are also under investigation by those skilled in the art. Typically thermally driven membrane pumps have a membrane that fluctuates with the application of heat thereby changing the volume of a pump cavity causing fluid to move in and out of the cavity through inlet and outlet ports.

Diffuser pumps have inlet and outlet ports with increasing and decreasing cross-sectional area in the direction of the flow and are coupled to a chamber with an oscillating pressure. The kinetic energy or flow velocity of the fluid is transformed into potential energy or pressure in the pump. The efficiency of the process is greater in the diffuser direction than in the nozzle direction. The ports conduct more fluid in the diffuser direction than in the nozzle direction resulting a net pumping action.

A variety of rotary micropumps are known to those skilled in the art. One type such pumps is a jet or impeller type micropump. This micropump includes a thin rotor that pivots about a central pin often magnetically driven. The pump includes a central chamber with inlet and outlet ports. As the rotor rotates under the magnetic force, liquid is moved from the inlet port side to the outlet side of the pump chamber.

Another type of rotary micropump is the magnetically driven gear pump. In this type of pump tight tolerances between the teeth of two gears and the surrounding walls allow for the formation of low-leakage sliding seals. Fluid is pumped by the turning gears with the fluid being carried along the walls of the cavity enclosing the gears.

Electrohydrodynamic pumps have no moving parts but make use of electric fields for pumping. Electrohydrodynamic pumps use the electrical properties of the fluid being pumped. An applied electric field is used to induce charges in the fluid and also to electrostatically move the charges. These electrohydrodynamic pumps require either free charges in the fluid such as ions injected into the fluid by electrochemical reactions (injection-type electrohydrodynamic pumps) or a gradient/discontinuity in conductivity and/or permittivity in the fluids to be pumped. A gradient/discontinuity may be achieved through layered fluids, suspended particles or induced aniostropy and are often referred to as non-injection electrohydrodynamic pumps.

Electroosmotic and electrophoretic also have no moving parts. These types of pumps rely an injection of ions or gradients in conductivity/permittivity with the presence of ions and a suitable solvent. Electroosmotic and electrophoretic pumps can be used to move fluids or ions at flow rates in the range of microns up to millimeters per second for wide range of flow channel cross-sectional areas. Electrophoresis involves the movement of ions relative to solvent molecules under an externally generated electric field.

Electroosmotic pumping is more of a bulk phenomenon than electrophoresis and results in the pumping of an electrically natural fluid. Typically a double layer of opposite charges is formed in the solution near the channel walls and the charges in a double layer can then be moved under the influence of an externally applied electric field. The only region where there is significant concentrations of charges is in a double layer. The thin layer near the channel walls will move and doing so will osmotically draw fluid along with it.

Miniature. ultrasonic and vacuum pumps of also been developed and applied in practical applications by those skilled in the art. Although there are a variety of micropumps available, the present invention provides alternatives to and advantages over the prior art.

SUMMARY OF THE INVENTION

One embodiment of the invention includes a thermolysis reaction actuating pump system including a first set of walls defining a channel having a cross-sectional area less than one millimeters squared, and wherein a liquid is received in the channel. A second set of walls define a reaction chamber and a thermolytic body is carried in the reaction chamber. The first set of walls and second set of walls are constructed and arranged to all the flow of gas from the reaction chamber into the channel. A heater is positioned to provide heat to the thermolytic body and to disassociate the thermolytic body to produce gas to pump the liquid through the channel.

In another embodiment of the invention, the thermolytic includes a solid.

In another embodiment of the invention, and the olytic body includes a solid in granular form.

In another embodiment of the invention the thermolytic includes a solid in pellet form.

In another embodiment of the invention the thermolytic includes a solid in powder form.

In another embodiment of the invention the powder includes $(NH_4)$ $CO_3$.

In another embodiment of the invention the thermolytic body includes $(NH_4)$ $CO_3$ powder.

In another embodiment of the invention the liquid includes water.

In another embodiment of the invention the liquid includes deionized water.

Another embodiment of the invention further includes a silicon substrate and wherein the heater includes a diffused resistor formed in the silicon substrate.

In another embodiment of the invention heater includes a printed resistor.

In another embodiment that heater underlies the reaction chamber.

Another embodiment of the invention further includes a heater block interposed between the heater in the reaction chamber.

Another embodiment of the invention further includes an adhesive layer interposed between the heater block and the second set of walls defining reaction chamber.

In another embodiment of the invention the first set of wall includes a photoresist layer.

In another embodiment of the invention the first set of walls includes polymethyl methylacrylate.

In another embodiment of the invention at least a portion of the first set of walls includes a silicon substrate.

In another embodiment of the invention the channel has a width and a height each less than 500 microns.

In another embodiment of the invention the channel has a width and a height each equal to or less than 300 microns.

Another embodiment of the invention further includes a first substrate and wherein the heater includes a printed resistor formed on the first substrate.

In another embodiment of the invention the thermolytic body includes a substance capable of disassociating upon the application of heat to produce gas.

Another embodiment of the invention includes a method of pumping fluid including providing a pump system having a first set of walls defining a channel and a liquid carried in the channel at a first location, a second set of walls defining a reaction chamber and a thermolytic body carried in the reaction chamber, the first set of walls and second set of walls being constructed and arranged to allow gas to travel from the reaction chamber through the channel, and heating the thermolytic body thereby disassociating the thermolytic body to produce gas in an amount to displace the liquid in the channel to a second location.

In another embodiment of the invention the thermolytic includes a solid.

In another embodiment of the invention the thermolytic includes a powder.

In another embodiment of the invention the thermolytic includes $(NH_4)$ $CO_3$ powder.

Another embodiment of the invention further includes cooling the system so that the fluid returns to the first location.

In another embodiment of the invention the thermolytic body is heated to a temperature at least as great as 50° C.

Another embodiment of the invention the thermolytic body is heated to a temperature at least as great as 56° C.

In another embodiment of the invention the thermolytic body is heated to a temperature at least as great as 64° C.

In another embodiment of the invention the liquid includes deionized water.

These and other objects, features and advantages of the present invention will become apparent from the following brief description of the drawings, detailed description of the preferred embodiments, and appended claims and drawings.

DETAILED DESCRIPTION OF THE PREFERRED EMBODIMENTS

Figure 1:
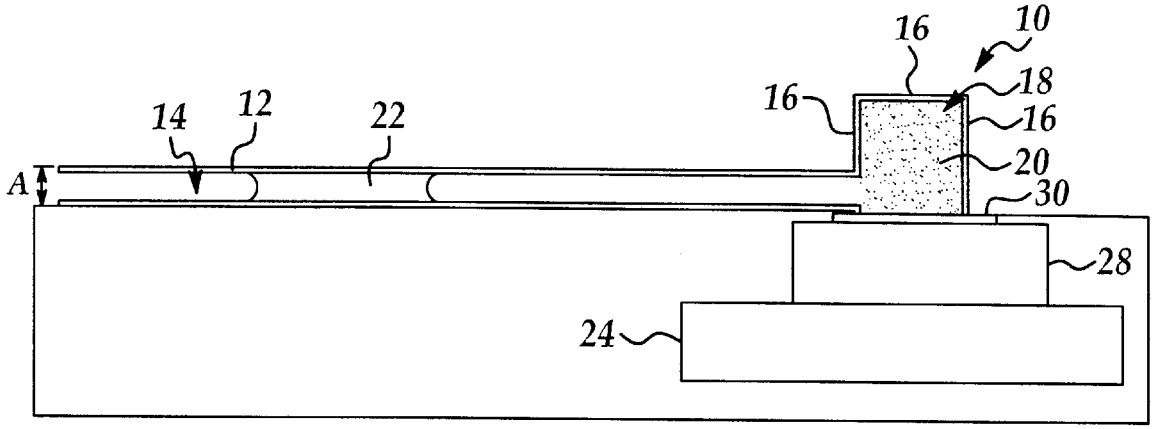
FIG. 1 illustrates a thermolysis reaction actuating bump according to the present invention.

FIG. 1 illustrates a micropump system 10 according to the present invention including a thermolysis reaction actuating pump. The system includes a first set of walls 12 defining a microscale channel 14. The channel 14 has a height, width or diameter (as indicated by line A in FIG. 1) that is less than 1 mm, preferably 100–500 microns, and most preferably 100–300 microns. The channel 14 and associated walls 12 may be formed by any of a variety of microfabrication techniques, several examples of which will be described hereafter. A second set of walls 16 define a reaction chamber 18 and are constructed and arranged to provide communication between the reaction chamber 18 and the channel 14 so that liquid and/or gases may flow from the reaction chamber 18 into and through the channel 14. A thermolytic substance or thermolytic body 20 is carried in the reaction chamber 18. The thermolytic body 20 may be in liquid or solid form. In a preferred embodiment the thermolytic body 20 is a non-liquid material that may be present in a solid block form, solid granular form, solid pellet form, or most preferably in a solid powder form. The thermolytic body 20 is capable of undergoing a thermolysis reaction upon the application of heat. The thermolysis reaction disassociates the body (substance) producing gases, and in some cases gases and liquids. In a preferred embodiment, the thermolytic body 20 includes $(NH_4)HCO_3$ that is disassociated upon the application of heat to produce ammonia gas ($NH_3$), carbon dioxide ($CO_2$) and liquid water ($H_2O$). A liquid 22 such as deionized water is provided in the channel 14 and is pumped, displaced or moved along in the channel with the production of gases created by the thermolysis reaction of the thermolytic body 20. Heat may be applied to the thermolytic body 20 by any of a variety of methods. Preferably the heat is provided by a heater 24 which may be formed in or on a substrate 26. In a preferred embodiment the substrate 26 is a semiconductor material such as a silicon based body. The heater 24 may be provided by forming a diffused resistor in the silicon body by known semiconductor manufacturing techniques. Alternatively, the heater 24 may be provided by forming a film type resistor using a printed resistor ink on top of the substrate 26 which may be a silicon body or otherwise. A heater block 28 may be interposed between the heater 24 and the thermolytic body 20 in the reaction chamber 18. The heater block 28 helps to evenly transfer heat from the heater 24 to the thermolytic body the 20 in the reaction chamber 18. The heater block 28 is particularly helpful when a serpentine shaped printed resistor ink heater is utilized. An adhesive layer 30 may be provided between the heater block 28 and the thermolytic body 20 or the second set of walls 16 forming the reaction chamber 18. An adhesive layer 30 may also be utilized to secure a second substrate which may be utilized to provide at least a portion of the first and second sets of walls defining the channel 14 and reaction chamber 18 as will be described hereafter.

In operation, upon the occurrence of predetermined event such as a sensed parameter exceeding a threshold value as discussed earlier in the background of this invention, heat is applied to the thermolytic body 20 of the thermolysis reaction pump according to the present invention. When a sufficient amount of heat is applied the material or compound comprising the thermolytic body 20 begins to disassociate producing gases which flow from the reaction chamber 18 into the channel 14 thereby pumping the liquid 22 through the channel 14. As additional heat is continued to be applied to the thermolytic body 20 more gases are generated thereby pumping the liquid 22 further through the channel 14. For some liquids such as deionized water, the removal of the application of heat and cooling to the thermolytic body 20 and the system results in the deionized water returns to almost the identical location prior to the application of the heat to the thermolytic body 20.

Figure 2:
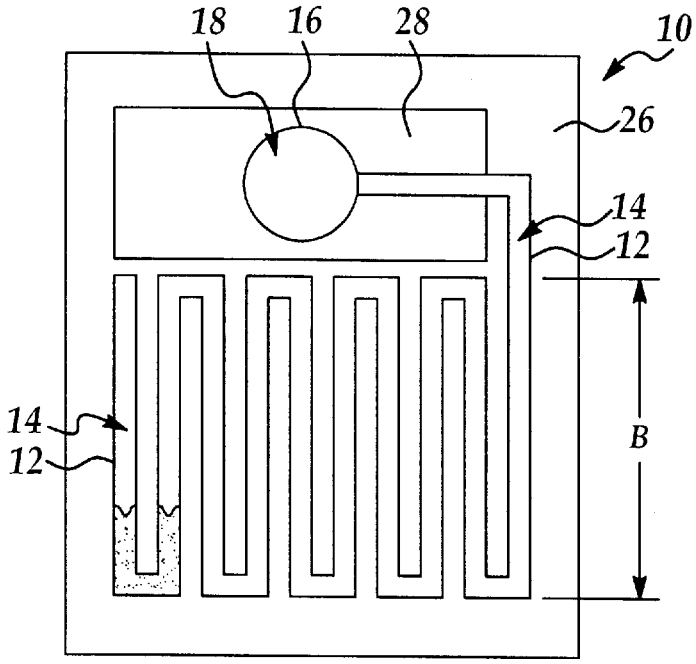
FIG. 2 is a plan view illustrating a thermolysis reaction actuating bump according to the present invention.

FIG. 2 is a plan view illustrating a thermolysis reaction actuating pump system 10 according to the present invention. In a preferred embodiment, the diameter of the reaction chamber 18 is approximately the 0.5 centimeters. The channel 14 is preferably a square configuration having a width and a height each of about 300 microns. The total length of the channel 14 is approximately the 20 centimeters. Preferably the channel 14 has a serpentine shaped portion which has a width has designated by line B of about two centimeters.

Figure 3:
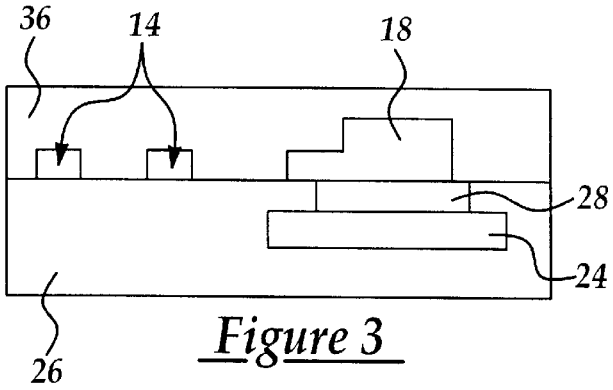
FIG. 3 illustrates a method of forming a micropump according to the present invention by bonding two substrates together.

The thermolysis reaction actuating pump according to the present invention may be manufactured by any of a variety of techniques. FIG. 3 illustrates one such method. A substrate 26 may be provided having a heater 24 and heater block 28 formed therein or on the upper surface of the substrate 26. A second substrate 36 is secured to the first substrate 26. The second substrate 36 may be any of variety materials including the a molded plastic having the channel 14 and reaction chamber 18 defined therein. The second substrate 36 may be secured to the first substrate 26 using an adhesive (not shown in FIG. 3). Preferably the second substrate 36 is a silicon based body having the channel 14 and reaction chamber 18 formed therein by known techniques such as etching. A silicon fusion bonding process is utilized to secure the second substrate 36 to the first substrate 26.

Figure 4A:
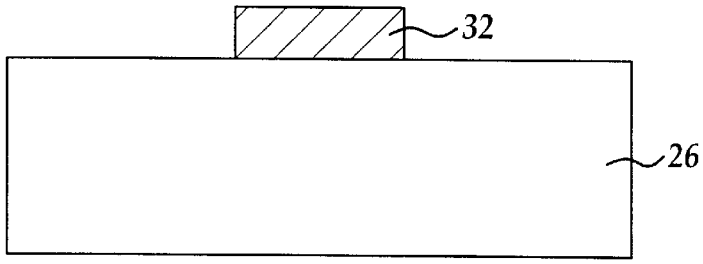
FIG. 4A illustrates a step of selectively depositing a first removable layer in a method of forming channels and reaction chamber in a micropump according to the present invention.
Figure 4B:
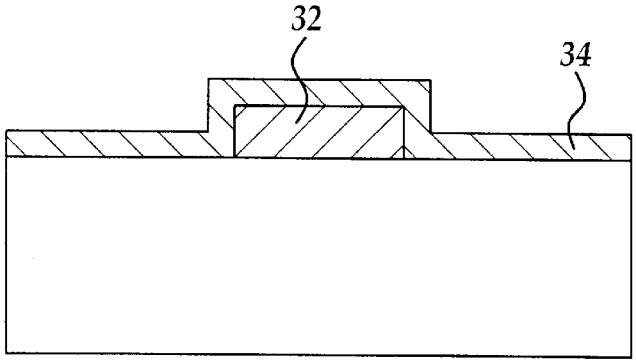
FIG. 4B illustrates a step of depositing a second layer over the first removable layer in a method of forming channels and reaction chambers in a micropump according to the present invention.
Figure 4C:
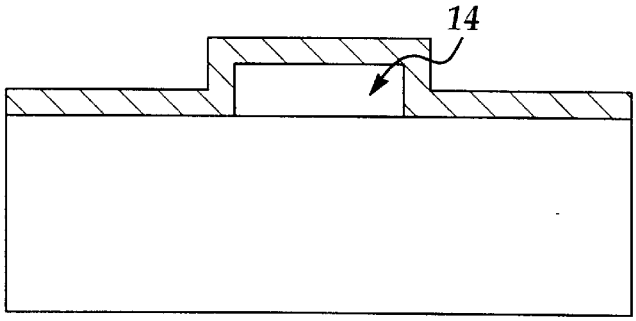
FIG. 4C illustrates a step of removing the first removable layer to form a channel or reaction chamber for a micropump according to the present invention.

FIGS. 4A–C illustrate another method of making the channel and reaction chamber of the micropump according to the present invention. A first removable material 32 such as a photoresist layer is selectively deposited on a substrate 26 preferably using photolithography techniques. A second layer 34 is deposited over the first removable layer 32 and the second layer 34 may also be a photoresist layer, for example, polymethyl methylacrylate. Thereafter, the first removable layer is removed by etching or other known techniques to provide a channel 14 or a reaction chamber 18 as desired.

Figure 5A:
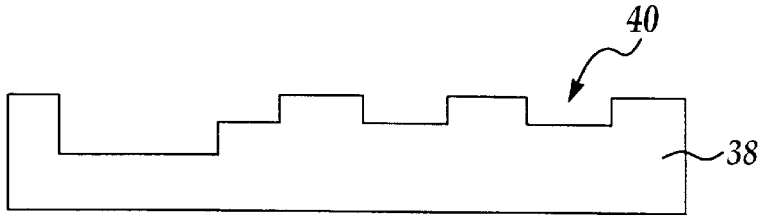
FIG. 5A illustrates the step of providing a mandrel having patterned features for a reaction chamber and microchannel formed therein for making a micropump according to the present invention.
Figure 5B:
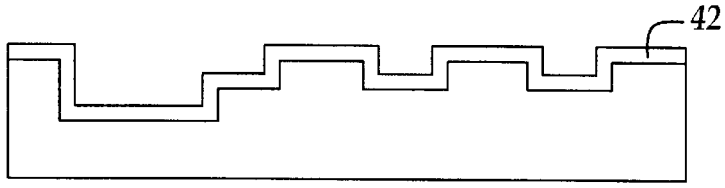
FIG. 5B illustrates a step of depositing with a first layer over the mandrel and into the patterned features formed therein for making a micropump according to the present invention.
Figure 5C:
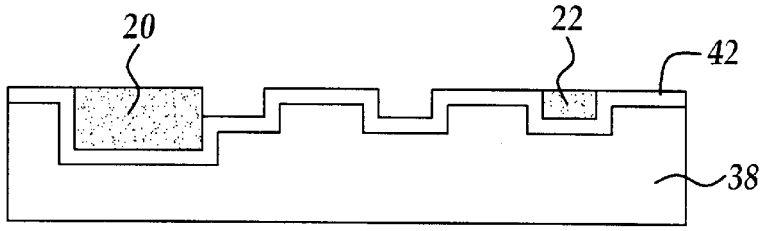
FIG. 5C illustrates the step of depositing a material capable of undergoing a thermolysis reaction into the reaction chamber for making a micropump according to the present invention.
Figure 5D:
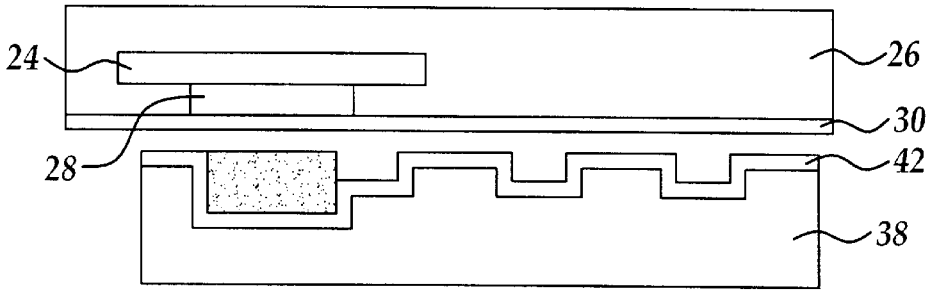
FIG. 5D illustrates the step of attaching a substrate having a heater and heater block formed therein onto the first layer of the mandrel for making a micropump according to the present invention.
Figure 5E:
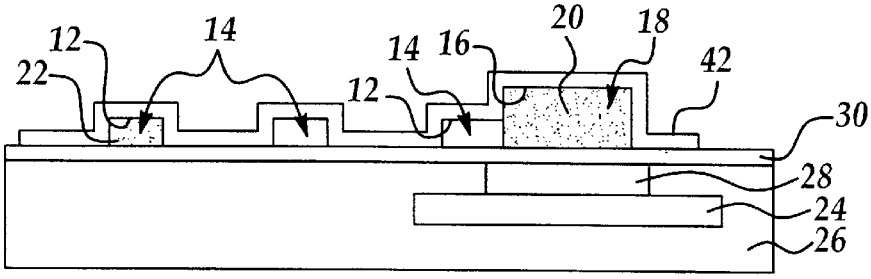
FIG. 5E illustrates the step of removing the substrate and the first layer from the mandrel to provide a micropump according to the present invention.

FIGS. 5A–E illustrate still another method of making a thermolysis reaction pump system according to the present invention. This method includes providing a mandrel 38 having patterned features 40 formed therein by micromachining, etching or other techniques (FIG. 5A). A first layer 42 such as a photoresist layer is deposited over the mandrel 38 and down into the patterned features 40 (FIG. 5B). The thermolytic body 20 may be deposited into a patterned feature corresponding to the reaction chamber 18 (FIG. 5C). If desirable, the fluid 22 may be also deposited in the patterned feature 40 corresponding to the channel 14. A first substrate 26 having a heater 24, heater block 28, and adhesive layer 30 may be provided in a construction as earlier described (FIG. 5D). The first substrate 26 is secured to the first layer 42 by the adhesive 30. Thereafter, the first substrate 26 and the first layer 42 are stripped away from the mandrel to provide a thermolysis reaction actuating pump 10 according to the present invention as earlier described (FIG. 5E).

Figure 6:
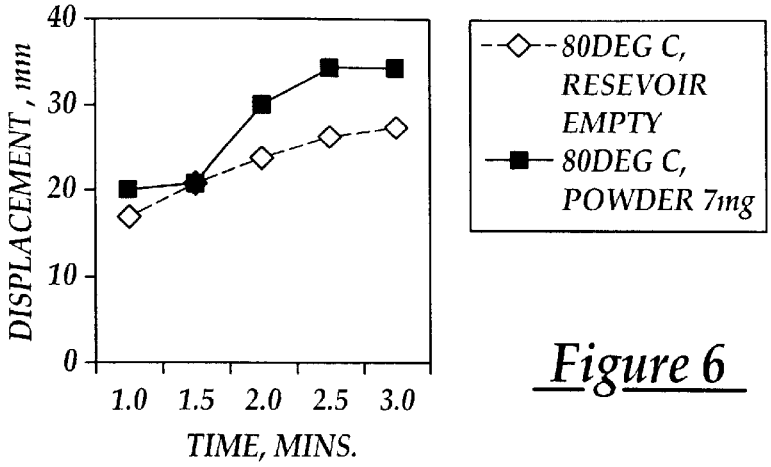
FIG. 6 is a graphic illustration of the displacement of a liquid in a thermolysis reaction actuating pump according to the present invention when the heater or hot plate is at 80° C.
Figure 7:
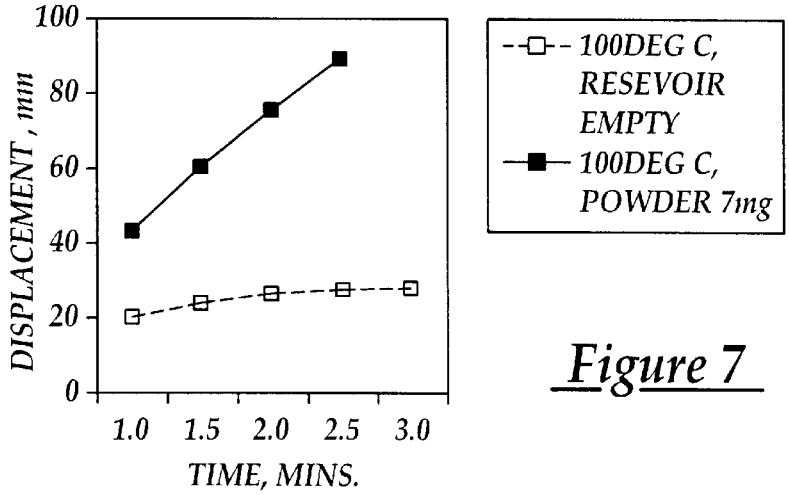
FIG. 7 is a graphic illustration of the displacement of a liquid in a thermolysis reaction actuating pump according to the present invention when the heater or hot plate is at 100° C.
Figure 8:
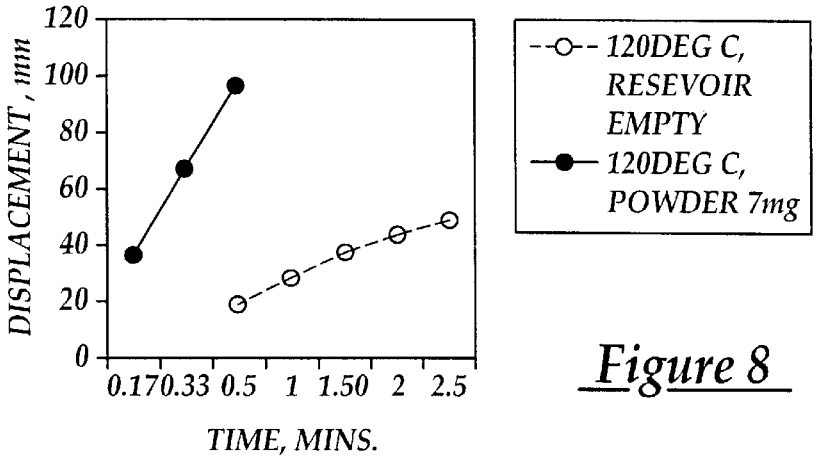
FIG. 8 is a graphic illustration of the displacement of a liquid in a thermolysis reaction actuating pump according to the present invention when the heater or hot plate is at 120° C.

FIGS. 6–8 are graphic illustrations of the displacement of deionized water in a thermolysis reaction actuating pump system having a channel 300 by 300 microns in cross-sectional area, and a thermolytic body 20 comprising 7 mg of $(NH_4)CO_3$ powder in the reaction chamber 18. The displacement of the deionized water when the thermolytic body 20 is present in reaction chamber is compared to the displacement of the deionized when the reaction chamber is empty. With respect to FIG. 6, the heater or hot plate 24 is heated to a temperature of 80° C. This produced a corresponding temperature in the thermolytic body 20 of 50° C. As will be appreciated, the displacement of the deionized water using the disassociation of the thermolytic body was not linear and only produced moderate improvements over time when compared to the absence of the thermolytic body.

With respect to FIG. 7, the heater 24 is heated to a temperature of 100° C. which produced a corresponding temperature of 56° C. in the thermolytic body 20. The displacement of the deionized water became linear over time with significant improvement compared to the empty reaction chamber.

With respect to FIG. 8, the heater was heated to a temperature of 120° C. which produced a corresponding temperature of 64° C. in the thermolytic body 20. The displacement of the deionized water was also linear with dramatic improvements compared to an empty reaction chamber. A thermolysis reaction actuating pump system according to the present invention is capable of producing three millimeters per second displacement of the fluid in the channel using a thermolytic body 20 including 7 mg of $(NH_4)$ $CO_3$ powder that is heated to a temperature ranging from 45–75° C.

Other materials for the thermolytic body 20 are listed in Table 1.

TABLE 1

| Candidate Thermolytic Body | Decomposition Temperature (° C.) | Major Decomposition |
|---|---|---|
| Ammonium dicarbonate $(NH_4)CO_3$ | 60 | $NH_3$, $CO_2$, $H_2O$ |
| Sodium dicarbonate $(NaHCO_3)$ | 100~140 | $CO_2$, $H_2O$ |
| Sodium borohydride $(NaBH_4)$ | 300 | $CO_2$, $H_2O$ |
| Azobisisobutyronitrile (AZDN) $(CH_3)_2(CN)C—N=N—C(CN)(CH_3)_2$ | 105 | $N_2$ |
| N,N'-dimethy-N,N' dinitroso-terephthalamide $(C_6H_4)—[Con(CH_3)—NO]_2$ | 118 | $N_2$ |
| 4,4'-Oxybis (benzenesulfonhydrazide) (OBSH) | 164 | $N_2$ |
| 3,3'-Sulfonbis(benzene-sulfonylhydrazide) (D-33) $SO_2(C_6H_4SO_2NH—NH_2)_2$ | 148 | $N_2$ |
| N,N'-Dinitroso Pentamethylene tetramine (DPT) other organic foaming agents | 195 | $N_2$ |

What is claimed is:

1. A thermolysis reaction actuating pump system comprising:

a first set of walls defining a channel having a cross-sectional area less than one millimeters squared;

a liquid received in the channel;

a second set of walls defining a reaction chamber and a thermolytic body carried in the reaction chamber;

the first set of walls and the second set of walls being constructed and arranged to allow the flow of gas from the reaction chamber into the channel;

a heater positioned to provide heat to the thermolytic body and to disassociate the thermolytic body to produce gas to pump the liquid through the channel.

2. A system as set forth in claim 1 wherein the thermolytic body comprises a solid.

3. A a system as set forth in claim 1 wherein the thermolytic body comprises a solid in granular form.

4. A system as set forth in claim 1 wherein the thermolytic body comprises a solid in pellet form.

5. A system as set forth in claim 1 wherein the thermolytic body comprises a solid in powder form.

6. A system as set forth in claim 5 wherein the powder comprises $(NH_4)CO_3$.

7. A system as set forth in claim 1 wherein the thermolytic body comprises $(NH_4)CO_3$ powder.

8. A system as set forth in claim 1 wherein the thermolytic body comprises a material selected from the group consisting of sodium dicarbonate $(NaHCO_3)$, sodium borohydride $(NaBH_4)$, azobisisobutyronitrile (AZDN), N,N'-dimethy-N, N' dinitroso-terephthalamide, 4,4'-oxybis (benzenesulfonhydrazide), 3,3'-sulfonbis(benzene-sulfonylhydrazide), N,N'-dinitroso pentamethylene tetramine and other organic foaming agents.

9. A system as set forth in claim 1 wherein the liquid comprises water.

10. A system as set forth in claim 1 wherein the liquid comprises deionized water.

11. A system as set forth in claim 1 wherein the liquid comprises biological or chemical solutions.

12. A system as set forth in claim 1 further comprising a silicon substrate and wherein the heater comprises a diffused resistor formed in the silicon substrate.

13. A system as set forth in claim 1 wherein the heater comprises a printed resistor.

14. A system as set forth in claim 1 wherein the heater underlies the reaction chamber.

15. A system as set forth in claim 14 further comprising a heater block interposed between the heater and reaction chamber.

16. A system as set forth in claim 15 further comprising an adhesive layer interposed between the heater block and the second set of walls defining the reaction chamber.

17. A system as set forth in claim 1 wherein the heater comprises infrared, laser or microwave heating sources.

18. A system as set forth in claim 1 wherein at least a portion of the first set of walls comprise a photoresist layer.

19. A system as set forth in claim 1 wherein at least a portion of the first set of walls comprise polymethyl methylacrylate.

20. A system as set forth in claim 1 wherein at least a portion of the first set of walls comprises polycarbonate, cycloolefin copolymer or a thermoplastic polymer material.

21. A system as set forth in claim 1 wherein at least a portion of the first set of walls comprises a thermosetting polymeric material.

22. A system as set forth in claim 1 wherein at least a portion of the first set of walls comprises glass or an inorganic material.

23. A system as set forth in claim 1 wherein at least a portion of the second walls comprise polymethyl methylacrylate.

24. A system as set forth in claim 1 wherein at least a portion of the second set of walls comprises polycarbonate, cycloolefin copolymer or a thermoplastic polymer material.

25. A system as set forth in claim 1 wherein at least a portion of the second set of walls comprises a thermosetting polymeric material.

26. A system as set forth in claim 1 wherein at least a portion of the second set of walls comprises glass or an inorganic material.

27. A system as set forth in claim 1 wherein at least a portion of first set of walls comprise a silicon substrate.

28. A system as set forth in claim 1 wherein at least a portion of the second set of walls comprise a silicon substrate.

29. A system as set forth in claim 1 wherein the channel has a width and a height each less than 500 microns.

30. A system as set forth in claim 1 wherein the channel has a width and a height each equal to or less than 300 microns.

31. A system as set forth in claim 1 further comprising a first substrate and wherein the heater comprises a printed resistor formed on the first substrate.

32. A system as set forth in claim 1 wherein the thermolytic body includes a substance capable of disassociating to produce gas upon the application of heat.

33. A method of pumping a liquid comprising:

providing a pump system having a first set of walls defining a channel and a liquid carried in the channel at a first location, a second set of walls defining a reaction chamber and a thermolytic body carried in the reaction chamber, the first set of walls and the second set of walls being constructed and arranged to allow gas to travel from the reaction chamber through the channel;

heating the thermolytic body thereby disassociating the thermolytic body to produce gas in an amount to displace the liquid in the channel to a second location.

34. A method as set forth in claim 33 wherein the thermolytic body comprises a solid.

35. A method as set forth in claim 33 wherein the thermolytic body comprises a powder.

36. A method as set forth in claim 33 wherein the thermolytic body comprises $(NH_{4)CO3}$ powder.

37. A method as set forth in claim 36 wherein the thermolytic body is heated to a temperature at least as great as 50° C.

38. A method as set forth in claim 36 wherein the thermolytic body is heated to a temperature at least as great as 56° C.

39. A method as set forth in claim 36 wherein the thermolytic body is heated to a temperature at least as great as 64° C.

40. A system as set forth in claim 33 wherein the thermolytic body comprises a material selected from the group consisting of sodium dicarbonate ($NaHCO_3$), sodium borohydride ($NaBH_4$), azobisisobutyronitrile (AZDN), N,N'-dimethy-N,N' dinitroso-terephthalamide, 4,4'-oxybis (benzenesulfonhydrazide), 3,3'-sulfonbis(benzenesulfonylhydrazide), N,N'-dinitroso pentamethylene tetramine and other organic foaming agents.

41. A method as set forth in claim 33 further comprising cooling the system so that the liquid returns to the first location.

42. A method as set forth in claim 33 wherein the liquid comprises deionized water.

43. A method as set forth in claim 33 wherein the liquid comprises biological or chemical solutions.

44. A method as set forth in claim 33 wherein the heating of the thermolytic body to performed so that the temperature of the thermolytic body ranges between 45–75° C.

45. A method as set forth in claim 33 wherein the heating of said thermolytic body is performed so that the temperature of said thermolytic body is between about 45–250° C., depending on the candidates chosen.

* * * * *